US010383454B2

(12) United States Patent
Romero et al.

(10) Patent No.: US 10,383,454 B2
(45) Date of Patent: Aug. 20, 2019

(54) MACHINE-WASHABLE VISCOELASTIC FOAM AND DEVICES MADE THEREFROM

(71) Applicant: Sinomax USA, Inc., Houston, TX (US)

(72) Inventors: Steven James Romero, Houston, TX (US); Terrence Richard O'Connor, Humble, TX (US)

(73) Assignee: SINOMAX USA, INC., Houston, TX (US)

( * ) Notice: Subject to any disclaimer, the term of this patent is extended or adjusted under 35 U.S.C. 154(b) by 22 days.

(21) Appl. No.: 15/156,234

(22) Filed: May 16, 2016

(65) Prior Publication Data

US 2016/0367041 A1 Dec. 22, 2016

Related U.S. Application Data

(63) Continuation of application No. 13/858,797, filed on Apr. 8, 2013, now abandoned.

(60) Provisional application No. 61/621,326, filed on Apr. 6, 2012.

(51) Int. Cl.

| | |
|---|---|
| ***A47C 27/15*** | (2006.01) |
| ***A47G 9/00*** | (2006.01) |
| ***A47G 9/10*** | (2006.01) |
| ***A47G 9/02*** | (2006.01) |
| ***A47C 27/14*** | (2006.01) |
| ***A47C 31/10*** | (2006.01) |

(52) U.S. Cl.

CPC ..... *A47C 27/15* (2013.01); *A47C 27/142* (2013.01); *A47C 31/105* (2013.01); *A47G 9/00* (2013.01); *A47G 9/0238* (2013.01); *A47G 9/0253* (2013.01); *A47G 9/10* (2013.01); *A47G 2009/1018* (2013.01); *Y10T 428/24802* (2015.01); *Y10T 428/249953* (2015.04); *Y10T 428/249991* (2015.04)

(58) Field of Classification Search

CPC ..... A47G 9/00; A47G 9/10; A47G 9/0253; A47G 9/0238; A47G 2009/1018; A47C 21/142; A47C 31/105; A47C 27/142; A47C 27/15; Y10T 428/24802; Y10T 428/249953; Y10T 428/249991

See application file for complete search history.

(56) References Cited

U.S. PATENT DOCUMENTS

| | | | | |
|---|---|---|---|---|
| 3,109,182 | A * | 11/1963 | Doak | A47C 27/22 5/636 |
| 2005/0278852 | A1* | 12/2005 | Wahrmund et al. | 5/636 |
| 2009/0007339 | A1* | 1/2009 | Chen et al. | 5/691 |
| 2012/0016046 | A1* | 1/2012 | Gerard et al. | 521/107 |
| 2013/0065043 | A1* | 3/2013 | Teran | 428/316.6 |

* cited by examiner

*Primary Examiner* — Amina S Khan

(74) *Attorney, Agent, or Firm* — Patterson + Sheridan, LLP

(57) ABSTRACT

A cushioning device includes a machine-washable polyurethan viscoelastic foam and a cavity for receiving a filler.

19 Claims, 2 Drawing Sheets

MACHINE-WASHABLE VISCOELASTIC FOAM AND DEVICES MADE THEREFROM

BACKGROUND

Field

Embodiments presented in this disclosure generally relate to polyurethane foams having viscoelastic properties. More specifically, embodiments pertain to machine-washable polyurethane viscoelastic foam and devices made therefrom.

Description of the Related Art

Viscoelastic foam, or "memory foam," is produced by reaction of polyol and isocyanate compounds, which results in a polyurethane foam having viscoelastic properties. Such viscoelastic foam has diverse applications, including pillows, mattresses, and other bedding devices.

Viscoelastic foam tends to absorb and retain water. As a result, devices made therefrom cannot easily be washed and dried. Typically, viscoelastic foam devices are covered using machine-washable covers (e.g., cotton covers). In such a conventional approach, the machine-washable covers are removed and laundered via an ordinary machine washing and drying cycle, while the viscoelastic foam devices themselves are manually spot cleaned.

As the foregoing illustrates, what is needed in the art are machine-washable viscoelastic foams and devices made therefrom.

SUMMARY

One embodiment of the invention is a machine-washable cushioning device which includes a polyurethane viscoelastic foam having density of 1-3 lb/ft$^3$, thickness of 0.5-1.5 cm, ILD rating of 3-12 lbs, recovery time of 3-7 seconds, and high airflow.

Other embodiments include, without limitation, the machine-washable cushioning device being a pillow, a pillow cover, and a mattress pad.

BRIEF DESCRIPTION OF THE DRAWINGS

So that the manner in which the above recited aspects are attained and can be understood in detail, a more particular description of aspects of this disclosure, briefly summarized above, may be had by reference to the appended drawings.

It is to be noted, however, that the appended drawings illustrate only typical aspects of this disclosure and are therefore not to be considered limiting of its scope, for this disclosure may admit to other equally effective aspects.

DETAILED DESCRIPTION

Embodiments presented herein provide a machine-washable cushioning device which includes a polyurethane viscoelastic foam. As used herein, machine-washable means capable of being laundered using a washing and drying cycle of a typical washing machine and drying machine. In order to be machine-washable, the viscoelastic foam may generally have low density, low thickness, and high airflow. Low density includes densities of about 1-4 lb/ft$^3$; preferably about 1-3 lb/ft$^3$. Low thickness includes thicknesses of about 0.25 cm to 2.5 cm; preferably about 0.5 cm to 1.5 cm. The foam may also include an indentation load deflection ("ILD") rating of about 3-12 lbs.; preferably about 7-9 lbs; and more preferably about 6-8 lbs. Further, the foam may have a high airflow value of about 30 to about 110. The viscoelastic foam may further have a recovery time of 3-7 seconds.

In some embodiments, the viscoelastic foam is quilted in the cushioning device, thereby preventing the viscoelastic foam from detaching from other layers and/or elements of the cushioning device. In further embodiments, the cushioning device includes, in addition to the viscoelastic foam, one or more layers of polyester, which provide space into which water from the viscoelastic foam can evaporate.

Figure 1:
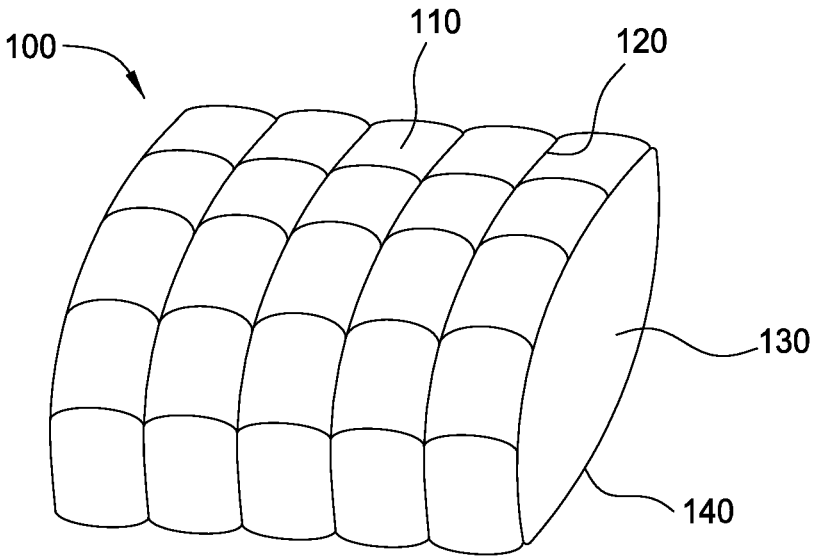
FIG. 1 is a perspective view of an example of a machine-washable pillow protector, according to an embodiment of the invention.

FIG. 1 is a perspective view of an example of a machine-washable pillow protector 100, according to an embodiment of the invention. As shown, the machine-washable pillow protector 100 includes a cover 110, quilting 120, a cavity 130, and a backside 140. The cover 110 and backside 140 may include any feasible sheeting material such as cotton, polyester, microfiber, lyocell, and combinations thereof.

The quilting 120 sews the cover 110 together with a machine-washable viscoelastic foam layer (not shown), which is described in greater detail below, and a backing (not shown). Quilting of the cover 110, a machine-washable viscoelastic foam layer, and a backing prevents the machine-washable viscoelastic foam from detaching from other layers and/or elements of the pillow protector 100. As a result, the pillow protector 100 may be repeatedly laundered without being damaged. Further, quilting may be preferable to gluing, because glue may fail after repeated washing, and glue tends to impart rigidity to the pillow protector 100. In one embodiment, the quilting includes a circular or parallelogram pattern having diameter or diagonal length of between 1 and 4 inches. Such a quilting pattern preserves the viscoelastic properties of the foam, which may diminish with finer quilting patterns.

The cavity 130 is defined by the backing quilted to the cover 110 and the backside 140. The cavity 130 permits a pillow to be placed therein. In one embodiment, a zipper may be used to secure the pillow in the cavity 130.

Although described with respect to the pillow protector 100, an alternative embodiment may take the form of a pillow. In such an embodiment, the cavity 130 may be filled with any feasible machine-washable filler such that the pillow is machine-washable as a whole. For example, a porous synthetic filler may be used, such as 16 oz or 20 oz Garneted polyester, polyester ball fibers, microveneer, down, and foam.

Figure 2:
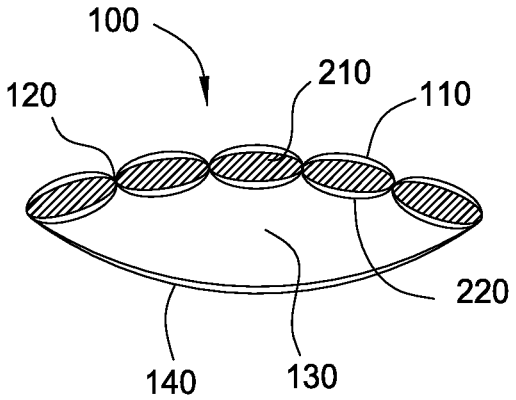
FIG. 2 is a cross-section view of the machine-washable pillow protector of FIG. 1.

FIG. 2 is a cross-sectional view of an exemplary machine-washable pillow protector of FIG. 1. As shown, the machine-washable pillow protector 100 includes a cover 110, quilting 120, a cavity 130, a backside 140, a machine-washable viscoelastic foam layer 210, and a backing 220. The cover 110, the quilting 120, the cavity 130, and the backside 140 are described in detail above.

The machine-washable viscoelastic foam layer 210 may generally have low density, low thickness, and high airflow. In particular, the machine-washable viscoelastic foam layer may have thickness of 0.25 cm to 2.5 cm, and the foam itself may have density of 1-3 lb/ft$^3$, ILD rating of 7-9 lbs, and airflow of about 30 to about 110. The density, ILD, and air flow value is measured using ASTM standard D-3574-05, including Test A for density, Test B for ILD, and Test G for air flow value. Further, the machine-washable viscoelastic foam may have a recovery time of 3-7 seconds such that the recovery response of the foam is similar to that of other viscoelastic foams used in bedding products. Viscoelastic foam having the foregoing properties can be machine laundered. In particular, such viscoelastic foam can be dried using a one-hour dry cycle, including a heat cycle.

The backing 220 may include common materials such as polypropylene and a polyester blend. The backing 220 takes the stitching of the quilting 120, thereby helping to secure the washable viscoelastic foam 210. The backing 220 need not include a woven material because a sleeping user does not typically come into contact with the backing 220. In some embodiments, however, the backing 220 may include a woven or down-proof material.

In some embodiments, one or more layers may be present in addition to the cover 110, machine-washable viscoelastic foam layer 210, and backing 220. For example, a polyester padding layer may be present between the cover 110 and the washable viscoelastic foam 210, or between the washable viscoelastic foam 210 and the backing 220. As a result of its porous nature, such a polyester padding layer may provide space into which water from the viscoelastic foam layer 210 can evaporate during a machine drying cycle, thereby helping the viscoelastic foam layer 210 to dry more rapidly. In another embodiment, an optional machine washable viscoelastic foam layer and backing may be quilted to the backside 140.

Figure 3:
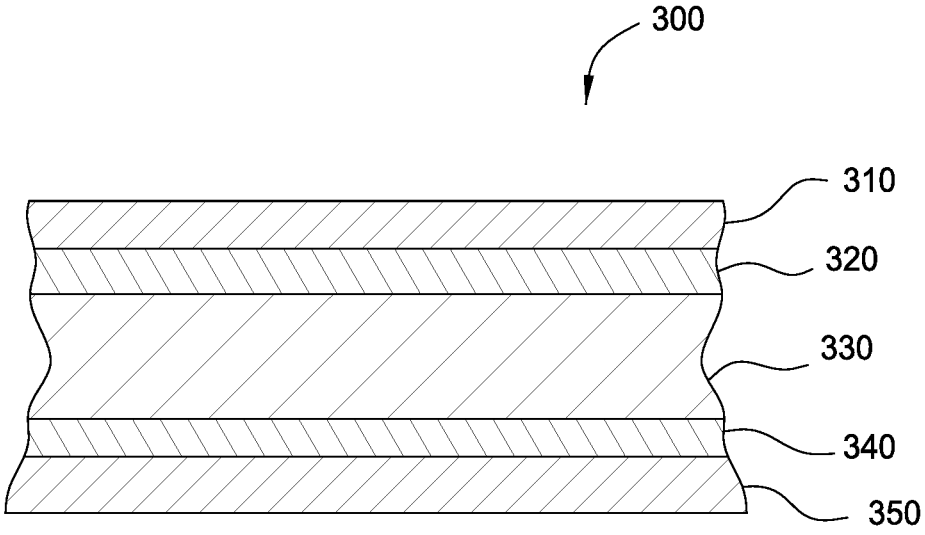
FIG. 3 is a cross-section view of an example machine-washable mattress pad, according to an embodiment of the invention.

FIG. 3 is a cross-section view of an exemplary machine-washable mattress pad 300, according to an embodiment of the invention. The mattress pad 300 includes covering layers 310 and 350, polyester layers 320 and 340, and machine-washable viscoelastic foam layer 330. The covering layers 310 and 350 may include any feasible sheeting material such as cotton, polyester, microfiber, lyocell, and combinations thereof.

The polyester layers 320 and 340 may include padding which is porous. Such padding may permit water from the viscoelastic foam layer 330 to evaporate during a machine drying cycle, thereby helping the viscoelastic foam layer 330 to dry more rapidly. Further, the polyester layers 320 and 340 may provide comfort loft. One or both of the polyester layers 320 and 340 may be optional. Any feasible type and thickness of polyester may be used for the polyester layers 320 and 340. For example, the polyester layer 320 may be 0.05 cm thick, and the polyester layer 350 may be 0.5 cm thick.

Like the viscoelastic foam described above with respect to FIG. 2, the machine-washable viscoelastic foam layer 330 may generally have low density, low thickness, and high airflow. In particular, the machine-washable viscoelastic foam layer may have thickness of 0.25 cm to 2.5 cm, and the foam itself may have density of 1-3 lb/ft$^3$, ILD rating of 7-9 ILD, and airflow of about 30 to about 110. Further, the machine-washable viscoelastic foam may have a recovery time of 3-7 seconds such that the recovery response of the foam is similar to that of other viscoelastic foams used in bedding products.

In some embodiments, one or more of the covering layers 310 and 350, the polyester layers 320 and 340, and the machine-washable viscoelastic foam layer 330 may be quilted. For example, cover layer 350 may be used as a backing layer, and all of the foregoing layers may be quilted together. Any feasible quilting pattern may be used, including the quilting patterns described above with respect to FIG. 1.

Although described above with respect to a pillow protector, a pillow, and a mattress pad, the machine-washable viscoelastic foam described herein may equally be used in other devices. For example, bed sheets, bed toppers, mattresses, and other cushioning devices may include the machine-washable viscoelastic foam described herein. Further, devices which are not cushioning devices may also employ the machine-washable viscoelastic foam described herein.

Advantageously, embodiments presented herein are capable of being laundered via ordinary washing and drying cycles. As a result, using additional protective coverings and performing manual spot cleaning are not required. Exemplary washers include top or front load types. In one embodiment, the pillow products and mattress pads may be washed using any suitable top or front load type washers. In another embodiment, a front load washer may be used to wash a Queen or King size mattress pad containing washable viscoelastic foam.

While the foregoing is directed to aspects of the present disclosure, other and further aspects of this disclosure may be devised without departing from the basic scope thereof, and the scope thereof is determined by the claims that follow.

What is claimed is:

1. A machine-washable cushioning device comprising:

a polyurethane viscoelastic foam layer having thickness of 0.5-1.5 cm, wherein the viscoelastic foam has density of 1-3 lb/ft$^3$, ILD rating of 3-12 lbs, and recovery time of 3-7 seconds; and a cover layer and a backing layer, wherein the polyurethane viscoelastic foam layer is sewed to and disposed between the cover layer and the backing layer.

2. The cushioning device according to claim 1, wherein the device is one of a pillow, a pillow protector, a mattress pad, or a bed sheet.

3. The cushioning device according to claim 1, wherein the viscoelastic foam has an ILD rating of 7-9 lbs.

4. The cushioning device according to claim 1, wherein the sewing includes a circular or parallelogram pattern, and wherein the diameter or diagonal length of each circle or parallelogram is 1-4 inches.

5. The cushioning device according to claim 1, further comprising a polyester padding layer between the cover layer and the backing layer.

6. The cushioning device according to claim 1, wherein the cover layer is selected from the group consisting of cotton, polyester, lyocell, microfiber, and combinations thereof, and wherein the backing layer includes one of polypropylene and a polyester blend.

7. The cushioning device according to claim 1, wherein the device is a pillow, and wherein the pillow is filled with a synthetic washable filler.

8. The cushioning device according to claim 7, wherein the synthetic washable filler is selected from the group consisting of polyester, polyester ball fiber, microveneer, down, foam, and combinations thereof.

9. The cushioning device according to claim 1, further comprising:

a backside layer attached to backing layer; and a cavity defined between the backside layer and the backing layer.

10. The cushioning device according to claim 9, further comprising a synthetic filler disposed in the cavity.

11. The cushioning device according to claim 10, wherein the sewing includes a circular or parallelogram pattern, and wherein the diameter or diagonal length of each circle or parallelogram is 1-4 inches.

12. The cushioning device according to claim 9, further comprising a polyester padding layer between the cover layer and the backing layer.

13. The cushioning device of claim 1, further comprising a first polyester padding layer between the cover layer and the foam layer.

14. The cushioning device of claim 1, further comprising a polyester padding layer between the foam layer and the backing layer.

15. The cushioning device of claim 13, further comprising a second polyester padding layer between the foam layer and the backing layer.

16. The cushioning device of claim 15, wherein the foam layer is sewed to the first polyester padding layer and the second polyester padding layer.

17. The cushioning device of claim 15, wherein the second polyester padding layer is thicker than the first polyester padding layer.

18. A machine-washable cushioning device comprising:

a polyurethane viscoelastic foam layer having thickness of 0.5-1.5 cm, wherein the viscoelastic foam has density of 1-3 lb/ft$^3$, ILD rating of 7-9 lbs, and recovery time of 3-7 seconds;

a cover layer and a backing layer, wherein the polyurethane viscoelastic foam layer is sewed to and disposed between the cover layer and the backing layer;

a backside layer attached to backing layer; and a cavity defined between the backside layer and the backing layer.

19. A machine-washable cushioning device comprising:

a cover layer;

a polyurethane viscoelastic foam layer having thickness of 0.5-1.5 cm, wherein the viscoelastic foam has density of 1-3 lb/ft$^3$, ILD rating of 3-12 lbs, and recovery time of 3-7 seconds;

a backing layer, wherein the polyurethane viscoelastic foam layer is disposed between the cover layer and the backing layer;

a first polyester padding layer between the foam layer and the cover layer; and a second polyester padding layer between the foam layer and the backing layer wherein the polyurethane viscoelastic foam layer, the first polyester padding layer, the second polyester padding layer, are sewed to the cover layer and the backing layer.

* * * * *